United States Patent [19]

Jornod

[11] 4,090,060

[45] May 16, 1978

[54] THERMAL PRINTHEAD CONTROL CIRCUIT

[75] Inventor: Eugene R. Jornod, Caledonia, Ill.

[73] Assignee: Barber-Colman Company, Rockford, Ill.

[21] Appl. No.: 764,217

[22] Filed: Jan. 31, 1977

[51] Int. Cl.[2] ..... H05B 1/00

[52] U.S. Cl. ..... 219/216; 346/76 R

[58] Field of Search ..... 219/216, 543; 346/76 R; 40/28 C; 340/324 R

[56] References Cited

U.S. PATENT DOCUMENTS

| | | | |
|---|---|---|---|
| 3,725,898 | 4/1973 | Canton | 340/324 |
| 3,965,330 | 6/1976 | Williams | 219/216 |
| 4,032,925 | 6/1977 | Kos | 346/76 R |

*Primary Examiner*—C. L. Albritton

*Attorney, Agent, or Firm*—Robert M. Hammes, Jr.

[57] ABSTRACT

A thermal printhead has heating elements arranged for multiplexing so as to limit the number of leads required to selectively energize the heating elements. Current diverting resistors are utilized to act as a shunt path to divert current from certain of the heating elements to prevent unwanted shadows from being produced on the thermal sensitive paper.

16 Claims, 4 Drawing Figures

THERMAL PRINTHEAD CONTROL CIRCUIT

BACKGROUND OF THE INVENTION

The invention relates to a control circuit for thermal printheads having individual heating elements which can be selectively energized to raise the temperature of thermally sensitive paper in contact with the printhead so as to form a desired array of dots on the paper. In particular, the invention relates to a thermal printhead circuit constructed to facilitate multiplexing of the heating elements so as to limit the number of leads required to connect the heating elements to a power source.

In constructing a thermal printhead having many heating elements significant problems exist due to the large number of wires required to connect the individual heating elements to means used to selectively energize the elements. It is thus desirable to provide a construction which reduces the number of lead connections required while still permitting maximum flexibility in selectively energizing the heating elements. A matrix of heating elements can be employed in a thermal printhead in which the elements are connected in such fashion as to form a plurality of possible parallel circuits which results in a reduction in the number of lead connections required. A problem encountered with such a matrix is that when selected heating elements are energized, some current travels through the other elements via the plurality of parllel sneak circuits. Consequently, one or more of the unselected elements may dissipate enough energy to mark the thermally sensitive paper thus creating undesirable shadows.

A common solution to this problem is to employ a multiplexing technique using diodes to prevent unselected elements from being energized while other elements are energized for printing. This results in high fabrication costs due to the labor required to mount the diodes. Further, the space taken up by the diodes undesirably increases the physical dimensions of the circuitry. Another way of solving this problem is described in U.S. Pat. No. 3,965,330. The printer head disclosed therein utilizes heating resistors having a switching characteristic to eliminate the shadow problem. When a certain threshold voltage is reached in a particular resistor the power dissipated is greatly increased and the thermally sensitive paper is marked. The current travelling through unselected resistors is not great enough to cause the threshold voltage to be exceeded. Thus, power dissipation is not great enough in these resistors to mark the paper. An undesirable feature is that the fabrication of a matrix using resistors having switching characteristics is more difficult and more expensive than fabrication of a matrix using conventional resistance devices.

SUMMARY OF THE INVENTION

According to the invention disclosed herein a thermal printhead has a matrix of heating elements connected between first and second sets of selecting terminals to facilitate selective energization of the heating elements. The interconnections of the heating elements in the matrix result in the formation of numerous parallel circuits when one or more heating elements are selected for energization. In order to prevent unselected heating elements from being energized to a level which would result in marking of the thermally sensitive paper, means is provided to divert current from unselected heating elements.

The invention thus allows for limiting the number of leads required to connect the printhead to a power source without the use of expensive components of fabrication techniques. A more complete understanding can be obtained from the following detailed description taken in conjunction with the drawing figures.

DETAILED DESCRIPTION OF THE PREFERRED EMBODIMENTS

Figure 1:
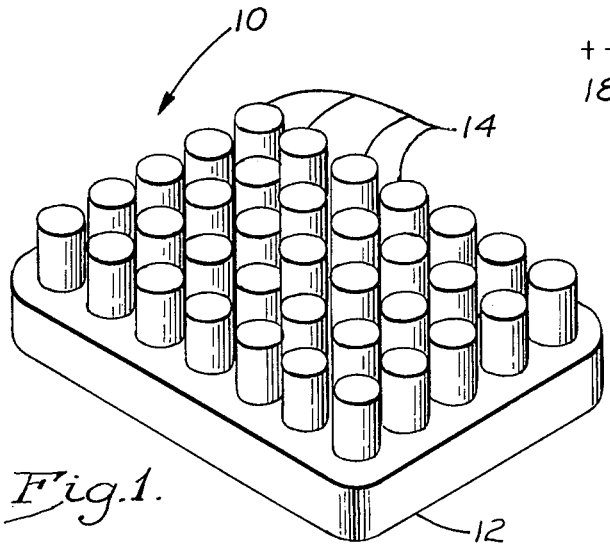
FIG. 1 is a perspective view of a thermal printhead having an array of heating elements.

A typical thermal printhead 10 is shown in FIG. 1. Printhead 10 is comprised of a base 12 and a plurality of heating elements 14. In practice, heating elements 14 of printhead 10 will be in contact with thermally sensitive paper (not shown) which changes color when heated above a critical termperature. By selectively energizing heating elements 14 the temperature of the thermally sensitive paper can be raised to the critical temperature in the vicinity of the selected heating element so as to mark the paper and record the desired information. The heating elements 14 can be formed in any of several ways, such as by semi-conductor fabrication methods or by forming thick or thin film resistors using silk screening techniques. Such printhead are well known.

It is readily apparent that providing separate power source connections for each of heating elements 14 would result in a excessive number of leads from printhead 10. Consequently, it is desirable to provide a normal printhead having a limited number of leads.

Figure 2:
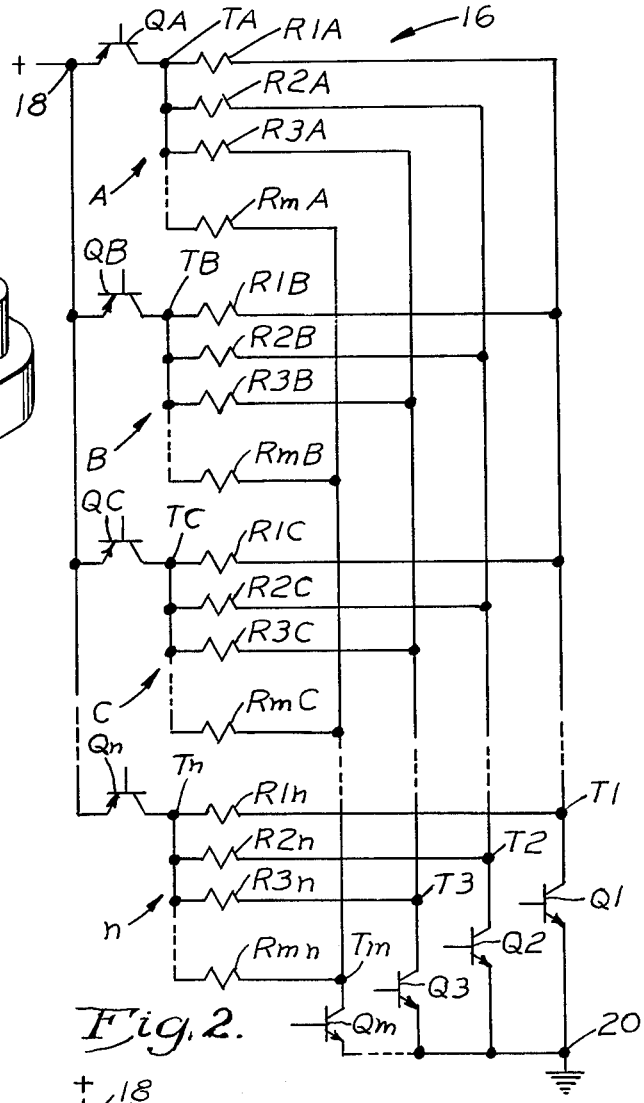
FIG. 2 is a schematic diagram of a circuit for multiplexing the heating elements of a thermal printhead.

Referring to FIG. 2, a matrix 16 of interconnected heating elements is shown which permits selective energization of heating elements using a limited number of power source connections. Any suitable type of heating element may be employed, but for convenience the elements described are referred to as heating resistors. Matrix 16 comprises a plurality of banks A, B, C...*n* of heating resistors. Each of banks A, B, C...*n* comprises a plurality of preferably equal valued heating resistors R1, R2, R3...Rm, the number of heating resistors in each bank preferably, but not necessarily, being equal to that in every other bank. For convenience, the heating resistors are hereafter further identified, when necessary, according to their respective banks. For example, heating resistor R1 in bank A is identified as R1A. Associated with banks A, B, C...*n* are a plurality of respective first selecting terminals TA, TB, TC...Tn. Each heating resistor in a given bank is connected at one end to the respective first selecting terminal associated with that bank. Thus, for example, heating resistors R1A, R2A, R3A...Rma of bank A all have one end connected to first selecting terminal TA as shown in FIG. 2. Heating resistor banks A, B, C...*n* are selectively addressed by sutiable coupling or switching means such as transistors QA, QB, QC...Qn connected between first power terminal 18 and respective ones of terminals TA, TB, TC...Tn. In order to facilitate the selection of individual heating resistors in a given bank, a plurality of second selecting terminals T1, T2, T3...Tm are provided, each of these terminals being connected to a single heating resistor in each of banks A, B, C...*n*. Thus, in FIG. 2, heating resistors R1A, R1B, R1C...R1n are all connected to terminal T1. The second resistor in each bank is connected to terminal T2, and so on. Thus each of the heating resistors is connected between a first selecting terminal and a second selecting terminal. It should be noted, however, that if the banks do not have equal numbers of heating resistors some of terminals T1, T2, T3...Tm will not be connected to a resistor in each bank. For example, if bank A has five resistors and banks B, C...*n* each have six resistors terminal T6 will be connected to a single resistor in each of banks B, C...*n* but not to a resistor in bank A. Individual heating resistors are selected by suitable coupling or switching means such as external transistors Q1, Q2, Q3...Qm connected between second power terminal 20 and respective ones of terminals T1, T2, T3...Tm.

In operation, one or more of the heating resistors can be energized by turning on appropriate combinations of transistors QA, AB, QC...Qn and transistors Q1, Q2, Q3...Qm. For example, heating resistors R1A, R2A, R3A...RmA are accessed by turning on transistor QA. The individual heating resistors R1A, R2A, R3A...-RmA can then be selectively energized to mark the thermally sensitive paper by turning on corresponding transistors Q1, Q2, Q3...Qm. If transistors QB, QC...Qn remain off, heating resistors in banks B, C...*n* are not selected for printing when transistors Q1, Q2, Q3...Qm are selectively turned on.

It will be seen that numerous parallel sneak circuits exist in matrix 16. Consequently, when one or more heating resistors are selected for printing current will flow through the unselected heating resistors as well. When the current flowing through an unselected heating resistor is insufficient to generate the heat required to raise the paper temperature above the critical point there is no problem. However, it has been observed that in some instances unselected heating resistors do generate enough heat to produce unwanted "shadow" dots. This problem is solved by providing means to divert current from unselected heating resistors so that heat generated in such resistors is not sufficient to reach the critical temperature.

Figure 3:
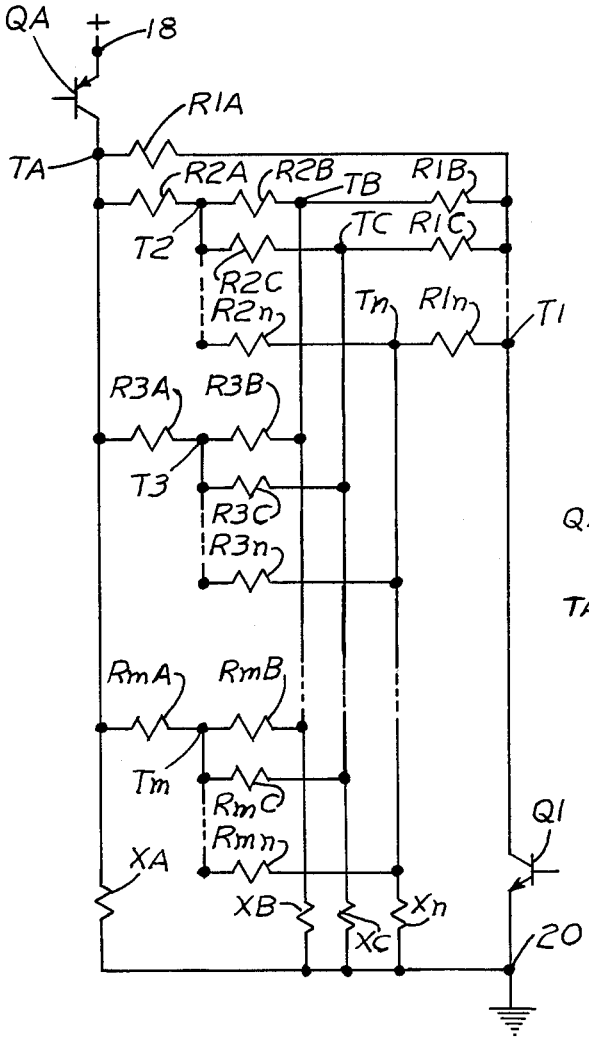
FIG. 3 is a schematic diagram of a portion of the circuit of FIG. 2 redrawn for better understanding and additionally showing means to divert current from unselected heating elements.

This situation can be better understood by considering the worst case condition, that is, when only one heating resistor is selected for energization. Referring to FIG. 3, when transistors OA and Q1 are turned on, the remaining transistors of FIG. 2 being off, heating resistor R1A is selected for printing. A plurality of sneak circuits parallel to heating resistor R1A exist. If printhead 10 has a relatively large number of heating resistors in each bank and a relatively small number of banks, the current flowing through, and consequently the heat generated in, heating resistors R1B, R1C, ...R1n may be great enough to cause undesired marking of the paper. In order to eliminate this condition current diverters such as resistors XA, XB, XC,...Xn, are connected respectively between terminals TA, TB, TC,...Tn and second power terminals 20. Resistors XB, XC,...Xn divert current from heating resistors R1B, R1C,... R1n and prevent undesired marking of the paper. Resistors XA, XB, XC,... Xn are likewise effective for other combinations of selected heating resistors since the resulting parallel circuits are similar.

Figure 4:
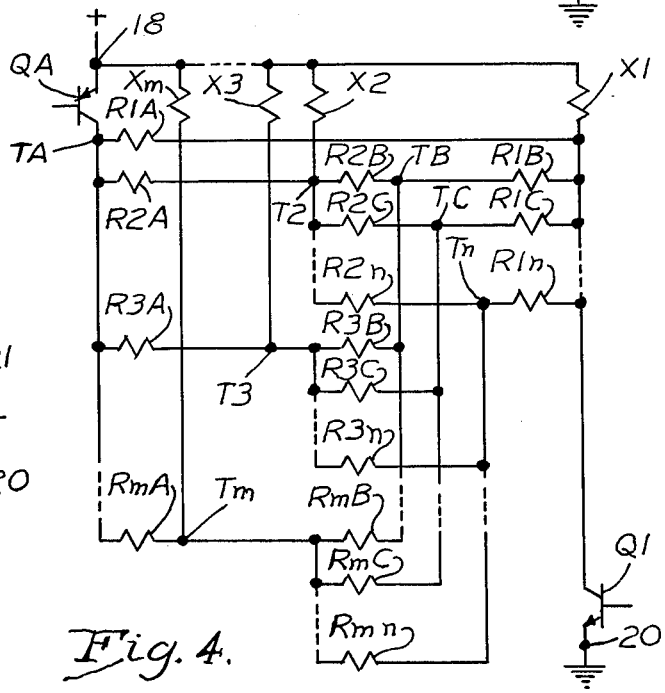
FIG. 4 is a schematic diagram similar to FIG. 3 but showing an alternate means to divert current from unselected heating elements.

Another arrangement is desirable if there exists a large number of banks with a small number of heating resistors in each bank. The worst condition again occurs if a single heating resistor is selected for marking. However, in this situation a larger current will flow through the resistors which are in the same bank as the selected resistor than will flow through the other heating resistors in the matrix. Referring to FIG. 4, when heating resistor R1A is selected by turning on transistors QA an Q1 the current flowing in unselected heating resistors R2A, R3A,... RmA may approach the critical level and cause undesired marking of the paper. In order to divert current from heating resistors R2A, R3A,... RmA current diverters such as resistors X1, X2, X3,...Xm, are connected respectively between terminals T1, T2, T3,... Tm and first power terminal 18. This arrangement is similarly effective for other combinations of selected heating resistors.

Resistors XA, XB, XC,...Xn and X1, X2, X3,...Xm may be located on the printhead 10 or they may be external to the printhead and should be lower in value than the heating resistors.

It will be apparent that other devices employing the principal of diverting current from unselected heating elements may be provided without departing from the scope and spirit of the invention. Consequently, the embodiments described herein are exemplary only and the invention is limited solely by the claims.

I claim:

1. A thermal printhead circuit comprising: a plurality of heating elements, a plurality of first selecting terminals fewer in number than said heating elements, and a plurality of second selecting terminals fewer in number than said heating elements, each of said second selecting terminals coupled to at least one of said first selecting terminals through a respective one of said heating elements, and each of said heating elements connected between a single first selecting terminal and a single second selecting terminal; a first power terminal; a second power terminal; first means for selectively coupling at least one of said first selecting terminals to said first power terminal; second means for selectively coupling at least one of said second selecting terminals to said second power terminal; and a current diverter connected in parallel to a series circuit comprising one of said heating elements and one of said selective coupling means connected together by one of said first and second selecting terminals.

2. A thermal printhead circuit according to claim 1 wherein each of said first selecting terminals is coupled to each of said second selecting terminals through a respective one of said heating elements.

3. A thermal printhead circuit according to claim 1 wherein said first selective coupling means comprises a plurality of switching elements connected between said first power terminal and respective ones of said first selecting terminals.

4. A thermal printhead circuit according to claim 3 wherein said second selective coupling means comprises a plurality of switching elements connected between said second power terminal and respective ones of said second selecting terminals.

5. A thermal printhead circuit according to claim 1 wherein said current diverter comprises an impedance element.

6. A thermal printhead circuit according to claim 5 wherein said impedance element comprises a resistor.

7. A thermal printhead circuit according to claim 5 wherein said impedance element has a lower impedance than the heating element in parallel therewith.

8. A thermal printhead circuit according to claim 1 comprising a plurality of said current diverters connected between said first power terminal and respective ones of said second selecting terminals.

9. A thermal printhead circuit according to claim 1 wherein said heating elements comprise resistance elements.

10. A thermal printhead circuit according to claim 9 wherein said resistance elements are substantially equal in resistance value.

11. A thermal printhead comprising: a plurality of heating elements, a plurality of first selecting terminals, and a plurality of second selecting terminals, each of said first selecting terminals connected to at least one of said second selecting terminals through a respective one of said heating elements, and each of said heating elements connected between a single of said first selecting terminals and a single of said second selecting terminals and; a diverter terminal adapted to be connected to an external power terminal; and a current diverter connected between said diverter terminal one of said first and second selecting terminals.

12. A thermal printhead according to claim 11 wherein said current diverter comprises an impedance element.

13. A thermal printhead according to claim 12 wherein said impedance element comprises a resistor.

14. A thermal printhead according to claim 11 comprising a plurality of said current diverters connected between said diverter terminal and respective ones of said first selecting terminals.

15. A thermal printhead according to claim 11 wherein said heating elements comprise resistance elements.

16. A thermal printhead according to claim 15 wherein said resistance elements are substantially equal in resistance value.

* * * * *